US010815680B2

(12) United States Patent
Woodward et al.

(10) Patent No.: US 10,815,680 B2
(45) **Date of Patent: *Oct. 27, 2020**

(54) APPARATUS HAVING A HANDLE ON WHICH A USER STANDS, AND METHOD

(71) Applicants: Steve Woodward, Meadville, PA (US); Joe Dangrow, Mercer, PA (US); Shannon Lessner, Madison, WI (US)

(72) Inventors: Steve Woodward, Meadville, PA (US); Joe Dangrow, Mercer, PA (US); Shannon Lessner, Madison, WI (US)

(73) Assignee: Werner Co., Greenville, PA (US)

( * ) Notice: Subject to any disclaimer, the term of this patent is extended or adjusted under 35 U.S.C. 154(b) by 54 days.

This patent is subject to a terminal disclaimer.

(21) Appl. No.: 15/077,489

(22) Filed: Mar. 22, 2016

(65) Prior Publication Data

US 2017/0275899 A1 Sep. 28, 2017

(51) Int. Cl.
*E04G 1/34* (2006.01)
*E04G 1/30* (2006.01)

(52) U.S. Cl.
CPC ..... *E04G 1/34* (2013.01); *E04G 1/30* (2013.01)

(58) Field of Classification Search
CPC ..... E06C 7/30; E06C 7/32; E06C 7/34
See application file for complete search history.

(56) References Cited

U.S. PATENT DOCUMENTS 581,727 A * 5/1897 English ..... E06C 1/005 182/30
2,723,073 A * 11/1955 Fellowes ..... A47B 88/906 229/166
2,832,648 A * 4/1958 Goosmann ..... B25H 1/06 16/346
3,848,700 A * 11/1974 Davis, Jr. ..... B25H 1/06 182/181.1
4,690,248 A * 9/1987 Killeen ..... E06C 1/39 182/118
5,282,519 A * 2/1994 Venturo ..... B25H 1/06 182/129
5,332,062 A * 7/1994 Revere ..... E04G 1/34 182/118
5,462,221 A * 10/1995 Zink ..... B65D 5/0055 229/117.16

(Continued)

FOREIGN PATENT DOCUMENTS

JP 2006 022530 A 1/2006

*Primary Examiner* — Katherine W Mitchell
*Assistant Examiner* — Shiref M Mekhaeil
(74) *Attorney, Agent, or Firm* — Ansel M. Schwartz

(57) ABSTRACT

An apparatus includes a platform having a first end and a second end and a handle. The apparatus includes a first leg assembly rotatably attached to the platform in proximity to the first end. The apparatus includes a second leg assembly attentively attached to the platform in proximity to the second end. When the first and second leg assemblies are essentially perpendicular to the platform, the apparatus is in a use state and the user is able to stand on the platform and be supported by the first and second leg assemblies. When the apparatus is in the use state, the user is able to pick up the apparatus by the handle with only one of the hands without tipping the apparatus. A method for a user with hands to stand on an apparatus.

8 Claims, 11 Drawing Sheets

(56) References Cited

U.S. PATENT DOCUMENTS 5,746,288 A * 5/1998 O'Neal ..... E04G 1/34 182/118
6,017,106 A * 1/2000 Adams ..... A45C 13/22 312/223.2
6,189,653 B1 * 2/2001 Laug ..... E06C 1/39 182/152
6,425,520 B1 * 7/2002 Peterson ..... B65D 71/36 229/117.12
6,427,804 B1 * 8/2002 Lazarus ..... A47C 7/008 182/153
D486,243 S * 2/2004 Yamaoka ..... D25/62
6,808,105 B2 * 10/2004 Lee ..... B65D 5/4608 229/117.09
7,210,560 B2 * 5/2007 Brink ..... A47C 4/18 135/95
7,516,704 B2 * 4/2009 Snider ..... B25H 1/04 108/25
7,690,316 B2 * 4/2010 Yoo ..... E04G 1/34 108/115
8,113,316 B2 * 2/2012 Sward ..... G01N 33/497 108/62
8,381,873 B2 2/2013 Cross et al.
8,777,683 B2 * 7/2014 Friedman ..... B63B 35/7946 441/74
9,120,218 B1 * 9/2015 Stehlik ..... B25G 1/10
9,752,334 B2 * 9/2017 Foley ..... E04G 1/34
2002/0162841 A1 * 11/2002 Shamir ..... A61L 2/26 220/326
2003/0000770 A1 * 1/2003 Virtue ..... B25H 1/06 182/186.3
2004/0238278 A1 * 12/2004 Gibson ..... E04G 1/28 182/129
2004/0238280 A1 * 12/2004 Gibson ..... E04G 1/28 182/153
2009/0078165 A1 * 3/2009 Tseng ..... A47B 3/0912 108/6
2009/0123736 A1 * 5/2009 Green ..... B32B 27/10 428/334
2009/0133959 A1 * 5/2009 Eriksson ..... E04G 1/34 182/118
2010/0071996 A1 * 3/2010 Huang ..... E04G 1/34 182/118
2010/0282540 A1 * 11/2010 Moss ..... B25H 1/06 182/119
2015/0267469 A1 * 9/2015 Markusen ..... E06C 1/16 182/21

* cited by examiner

APPARATUS HAVING A HANDLE ON WHICH A USER STANDS, AND METHOD

FIELD OF THE INVENTION

The present invention is related to a work platform which has a handle that allows the work platform to be lifted when in the use state without tipping. (As used herein, references to the "present invention" or "invention" relate to exemplary embodiments and not necessarily to every embodiment encompassed by the appended claims.) More specifically, the present invention is related to a work platform which has a handle that allows the work platform to be lifted when in the use state without tipping where the handle is disposed in the platform in his formed from two adjacent slots.

BACKGROUND OF THE INVENTION

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

Work platforms such as the Werner AP-30 provide end users with a safe and convenient means of reaching work areas (for painting, for example) which are beyond the reach of someone standing on the ground or floor. These work platforms typically consist of a platform with a pair of legs at each end which are folded up against the platform for transport or storage and are unfolded for use.

When the legs are unfolded for use, it can be awkward for the user to move the work platform as work progresses. Typically, the user would have to put down paint brushes, paint bucket, etc., and use both hands to pick up the work platform by its sides. Or, the user might use one hand to grasp the side edge of the work platform which results in the platform tipping and the extended legs potentially bumping into or becoming entangled with other objects in the work area.

It is desirable to have a handle on the work platform made and positioned in such a way as to allow the work platform to be conveniently picked up with one hand yet without tipping. In this disclosure, such a handle will be described.

BRIEF SUMMARY OF THE INVENTION

The present invention pertains to an apparatus on which a user with hands stands. The apparatus comprises a platform having a first end and a second end and a handle. The apparatus comprises a first leg assembly rotatably attached to the platform in proximity to the first end. The apparatus comprises a second leg assembly attentively attached to the platform in proximity to the second end. When the first and second leg assemblies are essentially in parallel with the platform, the apparatus is in a folded state. When the first and second leg assemblies are essentially perpendicular to the platform, the apparatus is in a use state and the user is able to stand on the platform and be supported by the first and second leg assemblies. When the apparatus is in the use state, the user is able to pick up the apparatus by the handle with only one of the hands without tipping the apparatus.

The present invention pertains to an apparatus on which a user with hands stands. The apparatus comprises a platform having a first end and a second end and a handle disposed in the platform. The handle has a first slot and a second slot adjacent the first slot. The first and second slots are disposed essentially in the platform's middle and have an oval shape. The apparatus comprises a support bar attached to the platform's bottom extending along the platform's centerline. The apparatus comprises a first insert disposed in the first slot and attached to the support bar. The first insert having a shape which conforms with the shape of the first slot. The apparatus comprises a second insert disposed in the second slot and attached to the support bar. The second insert having a shape which conforms with the shape of the second slots. The apparatus comprises a first leg assembly rotatably attached to the platform in proximity to the first end. The apparatus comprises a second leg assembly attentively attached to the platform in proximity to the second end. When the first and second leg assemblies are essentially in parallel with the platform, the apparatus is in a folded state. When the first and second leg assemblies are essentially perpendicular to the platform, the apparatus is in a use state and the user is able to stand on the platform and be supported by the first and second leg assemblies. When the apparatus is in the use state, the user is able to pick up the apparatus by the handle with only one of the hands without tipping the apparatus.

The present invention pertains to a method for a user with hands to stand on an apparatus. The method comprises the steps of placing the apparatus that is in a use state in a desired location. The apparatus comprises a platform having a first end and a second end and a handle; a first leg assembly rotatably attached to the platform in proximity to the first end, a second leg assembly attentively attached to the platform in proximity to the second end, when the first and second leg assemblies are essentially in parallel with the platform, the apparatus is in a folded state, when the first and on leg assemblies are essentially perpendicular to the platform, the apparatus is in a use state and the user is able to stand on the platform and be supported by the first and second leg assemblies, when the apparatus is in the use state, the user is able to pick up the apparatus by the handle with only one of the hands without tipping the apparatus. There is the step of placing an object on the platform. There is the step of grabbing the handle in the platform while the apparatus is in the use state. There is the step of lifting the apparatus by the handle with one hand by the user while the user's other hand is free so the apparatus does not tip and the object is not come off the platform. There is the step of placing the apparatus back down on to ground with the object still on the platform.

BRIEF DESCRIPTION OF THE SEVERAL VIEWS OF THE DRAWING

In the accompanying drawings, the preferred embodiment of the invention and preferred methods of practicing the invention are illustrated in which.

DETAILED DESCRIPTION OF THE INVENTION

Figure 1:
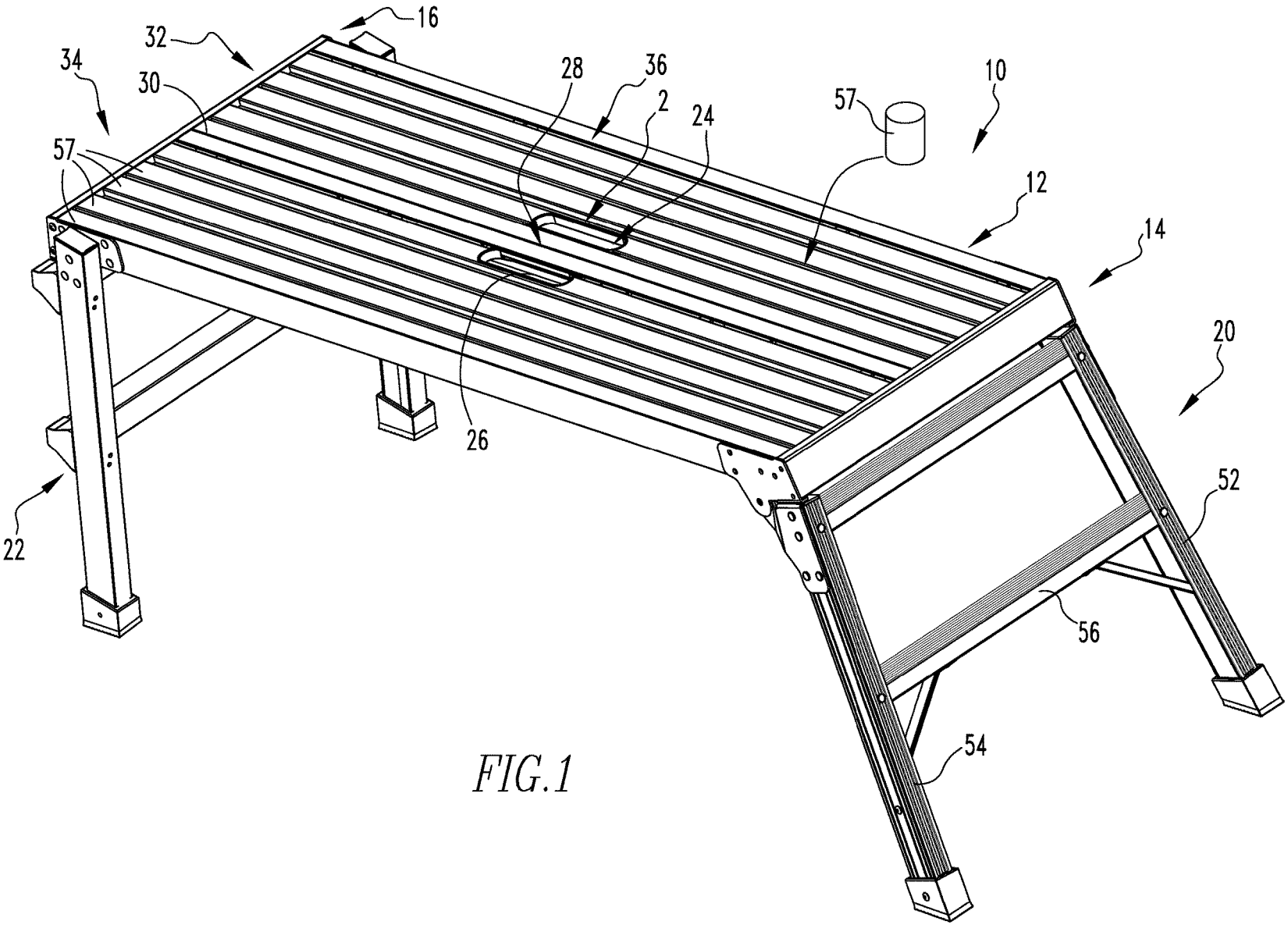
FIG. 1 shows a perspective view of a work platform with the legs extended and ready for use.
Figure 6:
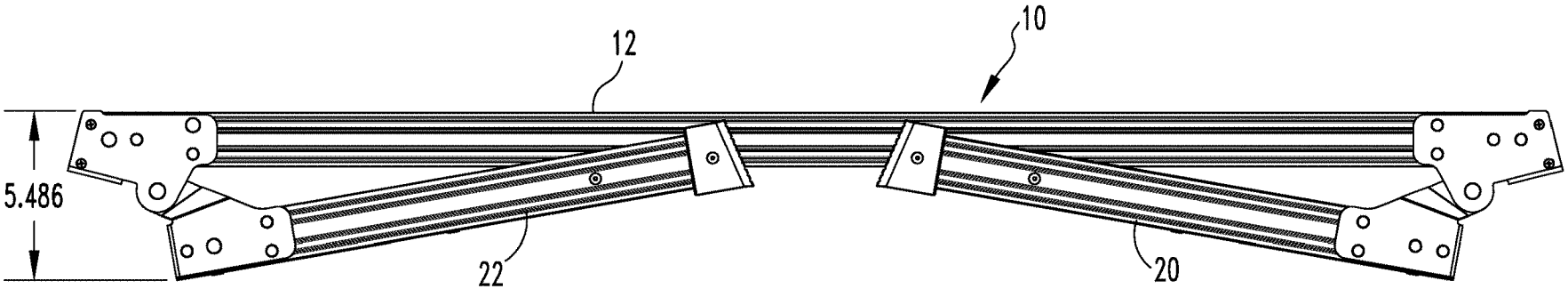
FIG. 6 shows the apparatus in a folded state.

Referring now to the drawings wherein like reference numerals refer to similar or identical parts throughout the several views, and more specifically to FIG. 1 thereof; there is shown an apparatus 10 on which a user with hands stands. The apparatus 10 comprises a platform 12 having a first end 14 and a second end 16 and a handle 2. The apparatus 10 comprises a first leg assembly 20 rotatably attached to the platform 12 in proximity to the first end 14. The apparatus 10 comprises a second leg assembly 22 attentively attached to the platform 12 in proximity to the second end 16. When the first and second leg assemblies 20, 22 are essentially in parallel with the platform 12, the apparatus 10 is in a folded state, as shown in FIG. 6. When the first and second leg assemblies 20, 22 are essentially perpendicular to the platform 12, the apparatus 10 is in a use state and the user is able to stand on the platform 12 and be supported by the first and second leg assemblies, as shown in FIG. 1. When the apparatus 10 is in the use state, the user is able to pick up the apparatus 10 by the handle 2 with only one of the hands without tipping the apparatus 10.

Figure 3:
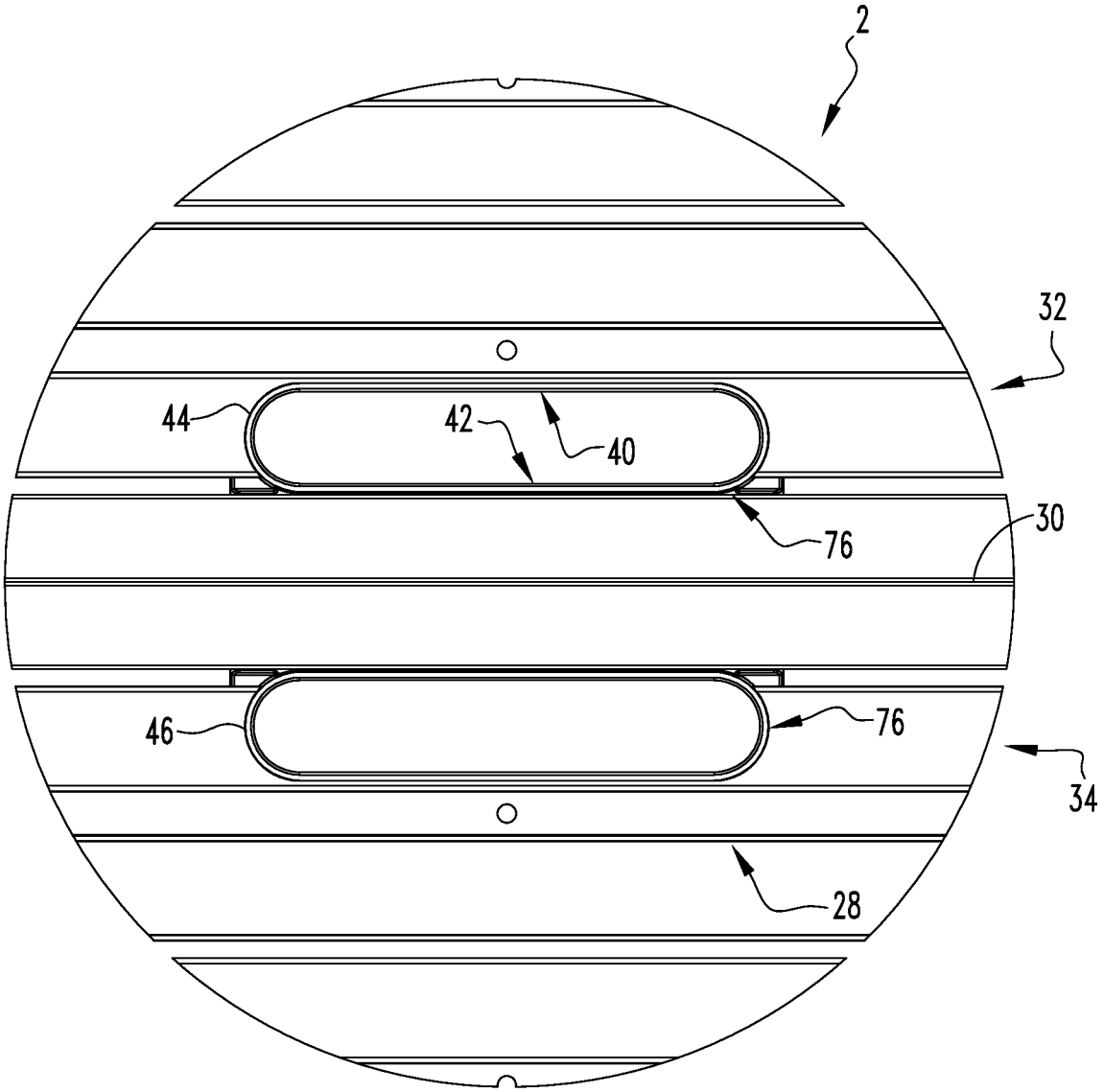
FIG. 3 shows a close up view of the handle construction details.

The handle 2 may be disposed in the platform 12. The handle 2 may have a first slot 24 and a second slot 26 adjacent the first slot 24, as shown in FIG. 3. The first and second slots 24, 26 are disposed essentially in the platform's middle 28. The handle 2 may have a centerline 30 and a center of gravity, and the first slot 24 is disposed on a first side 32 of the centerline 30 and above the platform's center of gravity and the second slot 26 is disposed on a second side 34 of the centerline 30 and above the platform's center of gravity. Each slot may extend through the platform 12 from the platform's top 36 to the platform bottom 38, as shown in FIGS. 3, 4 and 5.

Each slot may have a first elongate side 40 and a second elongate side 42 essentially in parallel and spaced relation with the first elongate side 40, with each elongate side essentially in parallel with the centerline 30, as shown in FIG. 3. Each slot may have an oval shape. The handle 2 may include a first insert 44 that fits in the first slot 24 and conforms with the oval shape of the first slot 24 and a second insert 46 that fits in the second slot 26 and conforms to the oval shape of the second slot 26.

Figure 4:
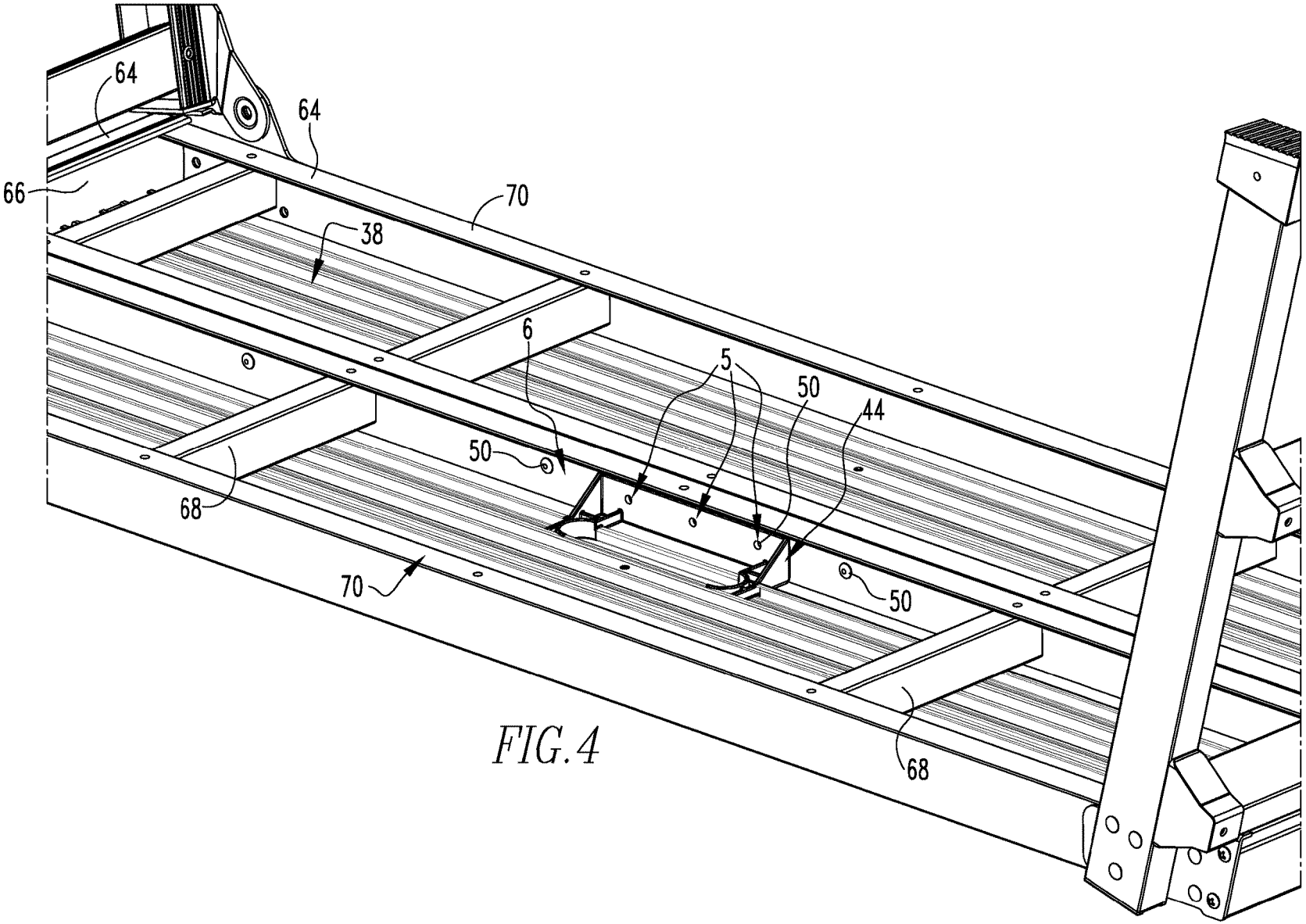
FIG. 4 shows the underside of the work platform
Figure 5:
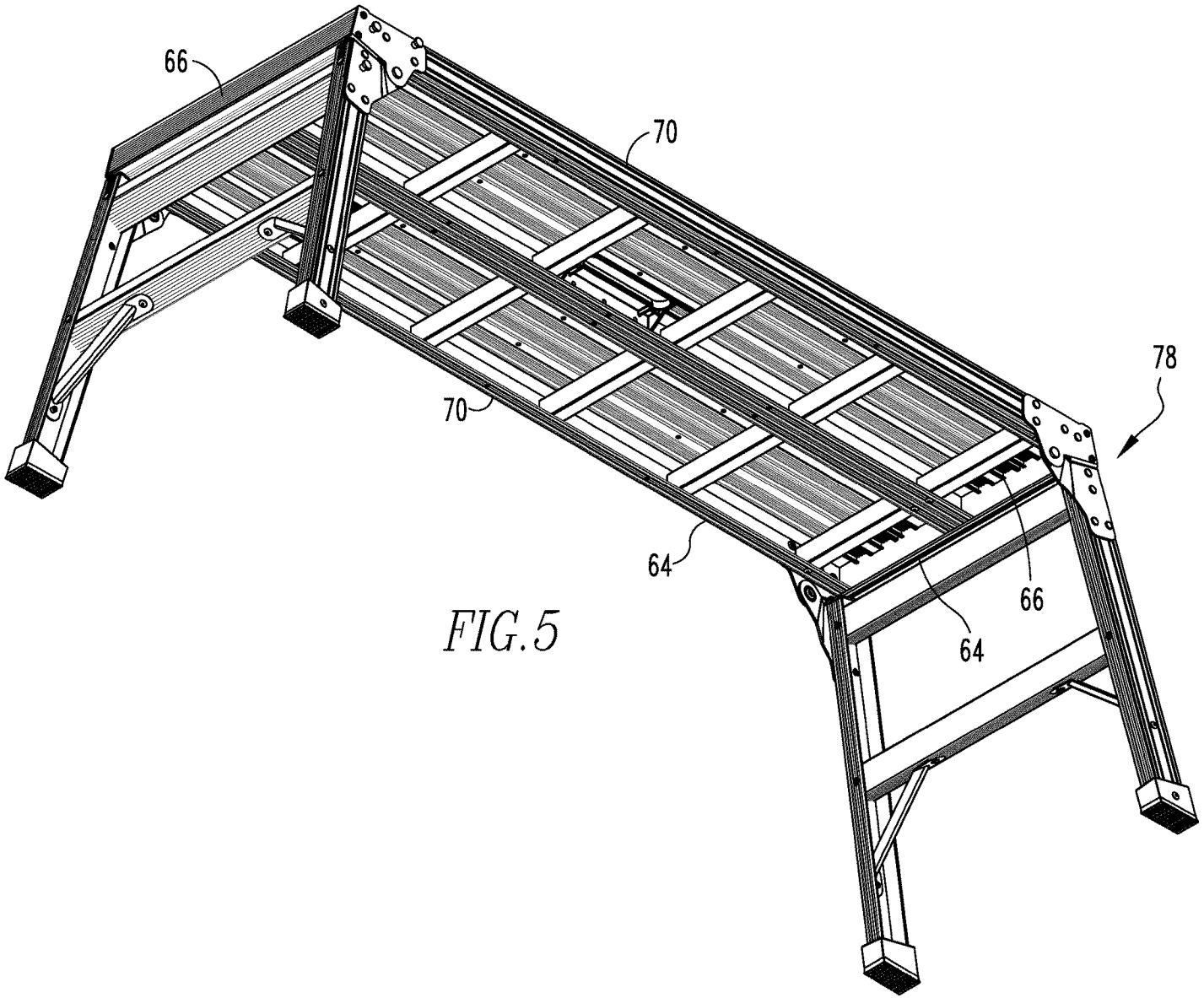
FIG. 5 shows the underside of the work platform.

Each insert may have holes 5 through which fasteners 50 extend to hold the insert to the slot, as shown in FIG. 4. The first and second leg assemblies 20, 22 each may be comprised of a first leg 52 and a second leg 54 in spaced relation and in parallel with the first leg 52, as shown in FIG. 1. Each leg assembly may have a step 56 attached between the first and second legs 52, 54 on which the user can step to reach and stand on the platform 12 when the apparatus 10 is in the use state.

The present invention pertains to and apparatus 10 on which a user with hands stands, as shown in FIGS. 1 and 3. The apparatus 10 comprises a platform 12 having a first end 14 and a second end 16 and a handle 2 disposed in the platform 12. The handle 2 has a first slot 24 and a second slot 26 adjacent the first slot 24. The first and second slots 24, 26 are disposed essentially in the platform's middle 28 and have an oval shape. The apparatus 10 comprises a support bar 6 attached to the platform's bottom 38 extending along the platform's centerline 30, as shown in FIGS. 4 and 5. The apparatus 10 comprises a first insert 44 disposed in the first slot 24 and attached to the support bar 6. The first insert 44 having a shape which conforms with the shape of the first slot 24. The apparatus 10 comprises a second insert 46 disposed in the second slot 26 and attached to the support bar 6. The second insert 46 has a shape which conforms with the shape of the second slot 26. The apparatus 10 comprises a first leg assembly 20 rotatably attached to the platform 12 in proximity to the first end 14. The apparatus 10 comprises a second leg assembly 22 attentively attached to the platform 12 in proximity to the second end 16. When the first and second leg assemblies are essentially in parallel with the platform 12, the apparatus 10 is in a folded state, as shown in FIG. 6. When the first and second leg assemblies are essentially perpendicular to the platform 12, the apparatus 10 is in a use state and the user is able to stand on the platform 12 and be supported by the first and second leg assemblies, as shown in FIG. 1. When the apparatus 10 is in the use state, the user is able to pick up the apparatus 10 by the handle 2 with only one of the hands without tipping the apparatus 10.

The present invention pertains to a method for a user with hands to stand on an apparatus 10. The method comprises the steps of placing the apparatus 10 that is in a use state in a desired location. The apparatus 10 comprises a platform 12 having a first end 14 and a second end 16 and a handle 2; a first leg assembly 20 rotatably attached to the platform 12 in proximity to the first end 14, a second leg assembly 22 attentively attached to the platform 12 in proximity to the second end 16, when the first and second leg assemblies are essentially in parallel with the platform 12, the apparatus 10 is in a folded state, when the first and on leg assemblies are essentially perpendicular to the platform 12, the apparatus 10 is in a use state and the user is able to stand on the platform 12 and be supported by the first and second leg assemblies, when the apparatus 10 is in the use state, the user is able to pick up the apparatus 10 by the handle 2 with only one of the hands without tipping the apparatus 10. There is the step of placing an object 57 on the platform 12. There is the step of grabbing the handle 2 in the platform 12 while the apparatus 10 is in the use state. There is the step of lifting the apparatus 10 by the handle 2 with one hand by the user while the user's other hand is free so the apparatus 10 does not tip and the object does not come off the platform 12. There is the step of placing the apparatus 10 back down on to ground with the object still on the platform 12.

Figure 7:
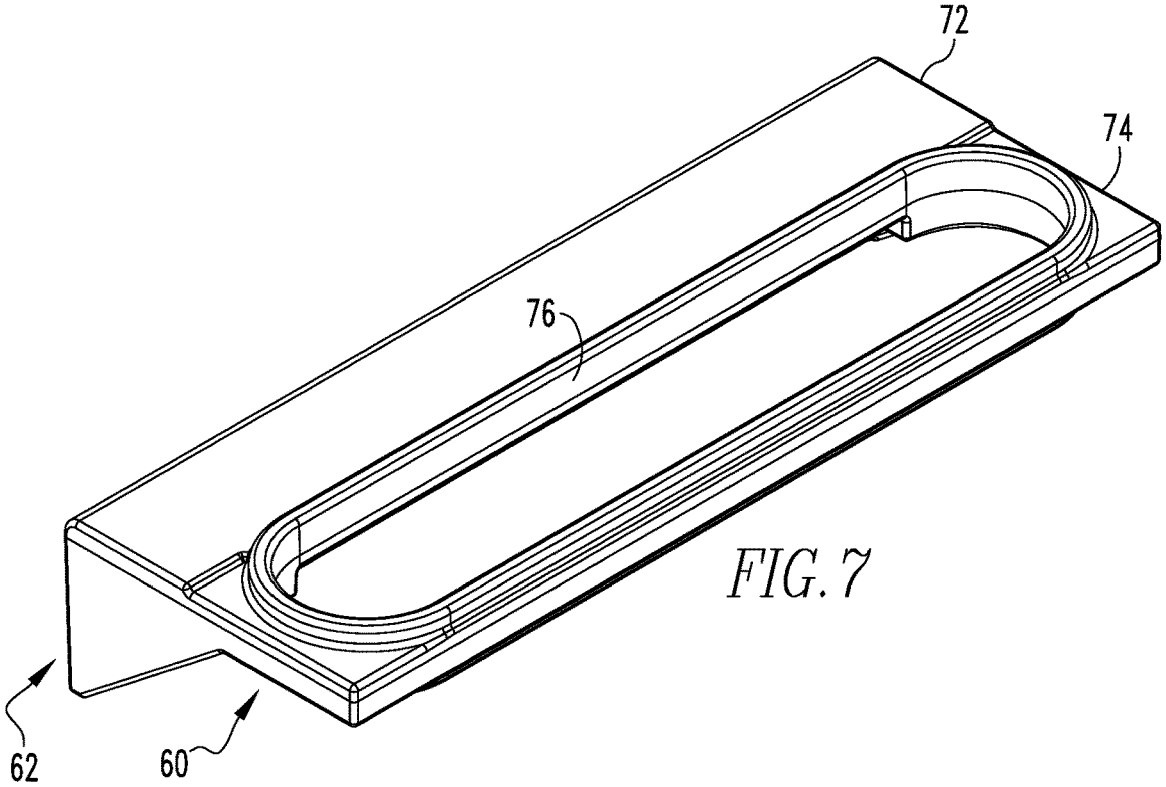
FIG. 7 shows an overhead perspective view of a handle insert
Figure 8:
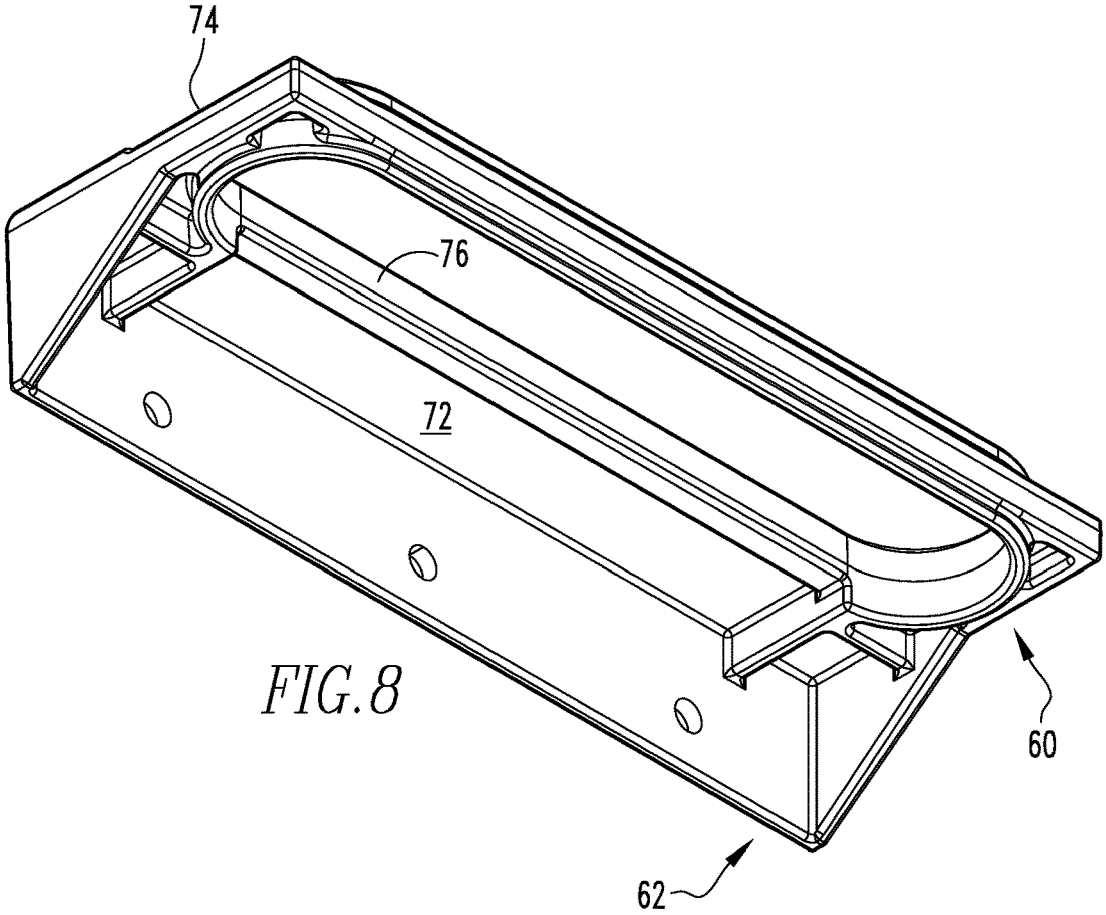
FIG. 8 shows an underside perspective view of a handle insert.

Each handle 2 insert has a first flange 60 and a second flange 62 that forms an angle, preferably about 90°, as shown in FIGS. 7 and 8, with the first flange 60. Essentially, the first flange 60 and second flange 62 together form an L shape. The second flange 62 has holes 5 that align with holes 5 in a support bar 6, as shown in FIGS. 4 and 5. The support bar 6 extends along the centerline 30 of the platform 12 and is attached to the bottom 38 of the platform 12. Each end of the support bar 6 rests on a lip 64 of an end flange 66 at each end of the platform 12. By resting on a lip 64 of an end flange 66 at each end of the platform 12, the support bar 6 is supported by the leg assemblies which extend down from the end flanges 66. The support bar 6 provides support and strength to the platform 12. In addition, there are pluralities of crossbars 68 that extend across the width of the platform 12 and are attached to the bottom 38 of the platform 12 and to the support bar 6, through which they extend. The end of each crossbar is on the lip 64 of a side flange 70 of the platform 12 on each long side of the platform 12. The crossbars 68 add even further strength and support to the platform 12.

The first flange 60 has a first section 72 that extends from the second flange 62 and a second section 74 that has an oval shaped opening, as shown in FIGS. 7 and 8 that fits into and corresponds with the oval shaped opening in the platform 12 of the slot. The oval shaped opening in the second section 74 has a ridge 76 extending from the surface of the second section 74 along the perimeter of the oval shaped opening. A hinge 78 at each corner of the platform 12 attaches the leg assemblies to the platform 12.

FIG. 1 shows a perspective view of a work platform 12 with the legs 52, 54 extended and ready for use. The legs 52, 54 are designed to fold up under the platform 12 to allow for convenient storage of the work platform 12 when not in use. One possible form of handle 2 is shown.

Figure 2:
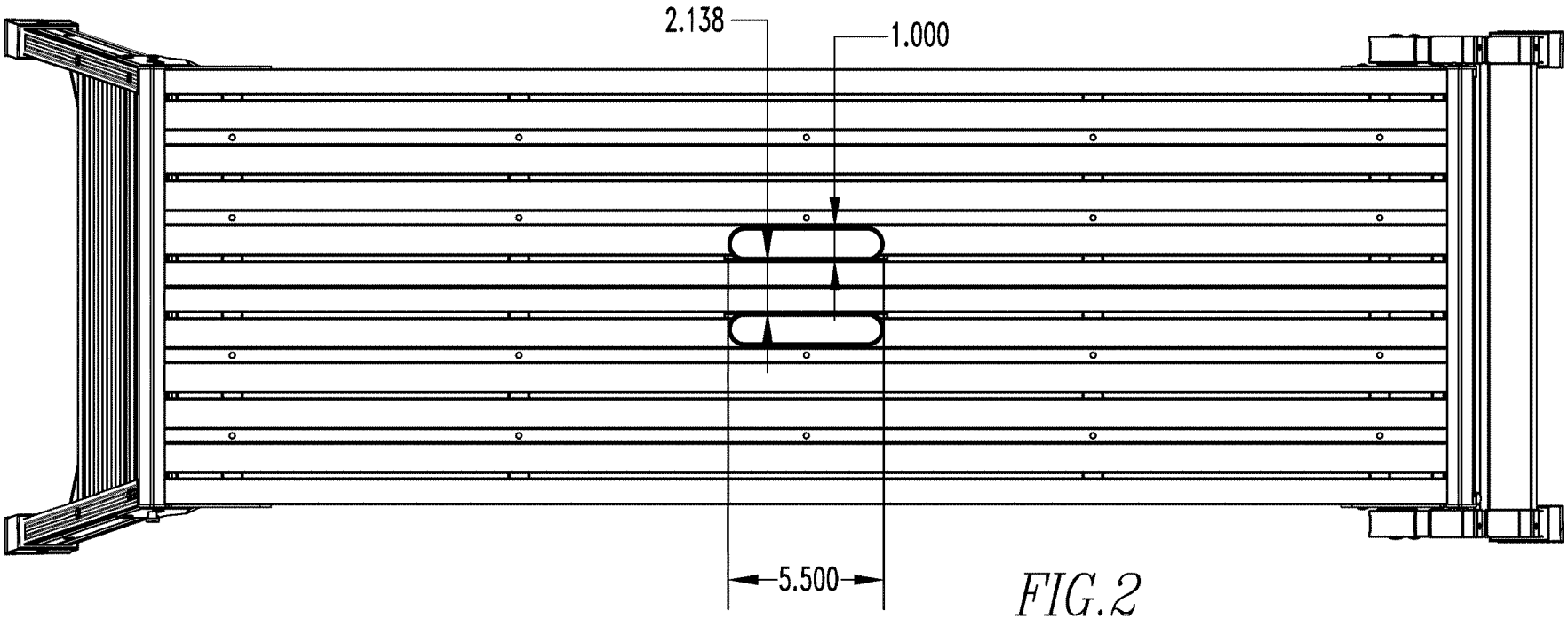
FIG. 2 shows a top view of the work platform.

FIG. 2 shows a top view of the work platform 12, with dimensions regarding the slot positions relative to each other and the platform. The handle 2 is formed by having slots 24, 26 in the work platform decking 57. The slots are located in the center of the work platform 12 above its center of gravity. These slots are sized to conform to the dimensions of a user's fingers. The slots are symmetric so as to be for use with either hand.

FIG. 3 shows a close up view of the handle 2 construction details. Handle inserts 44, 46 are located in the slots. These inserts insure that any potentially rough edges remaining after slots are formed in the work platform 12 decking are covered up. These inserts also provide a deeper gripping surface for the comfort of the user. The inserts could be made of molded plastic.

FIG. 4 shows the underside of the work platform 12 and details of how the inserts 44, 46 might be attached. Holes 5 in the inserts and the central support bar 6 allow for the use of screws or pop rivets, etc.

Figure 9:
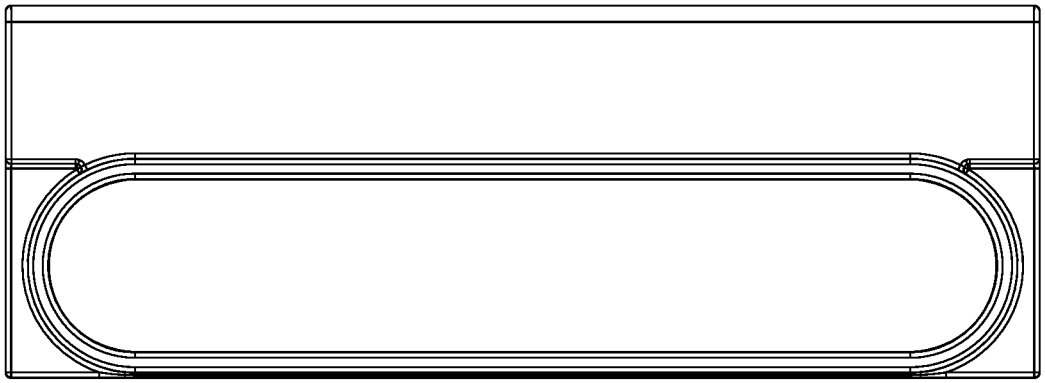
FIGS. 9-11 are overhead, side and underneath views, respectively, of a handle insert
Figure 10:
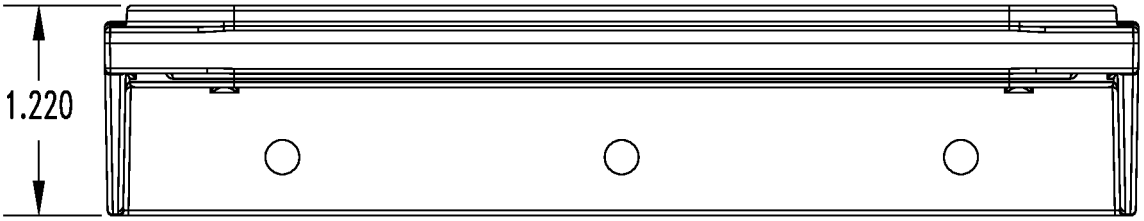
Figure 11:
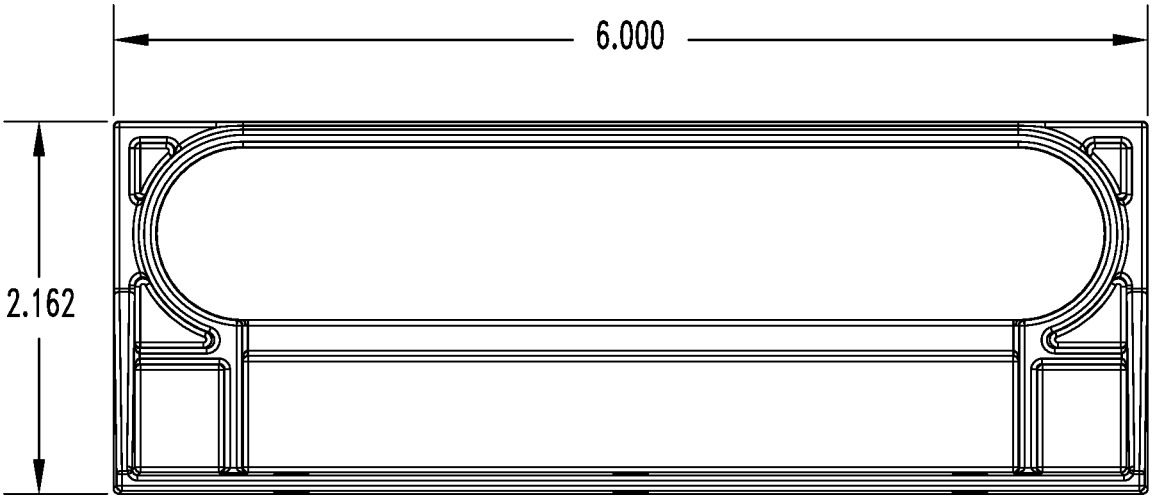
Figure 12:
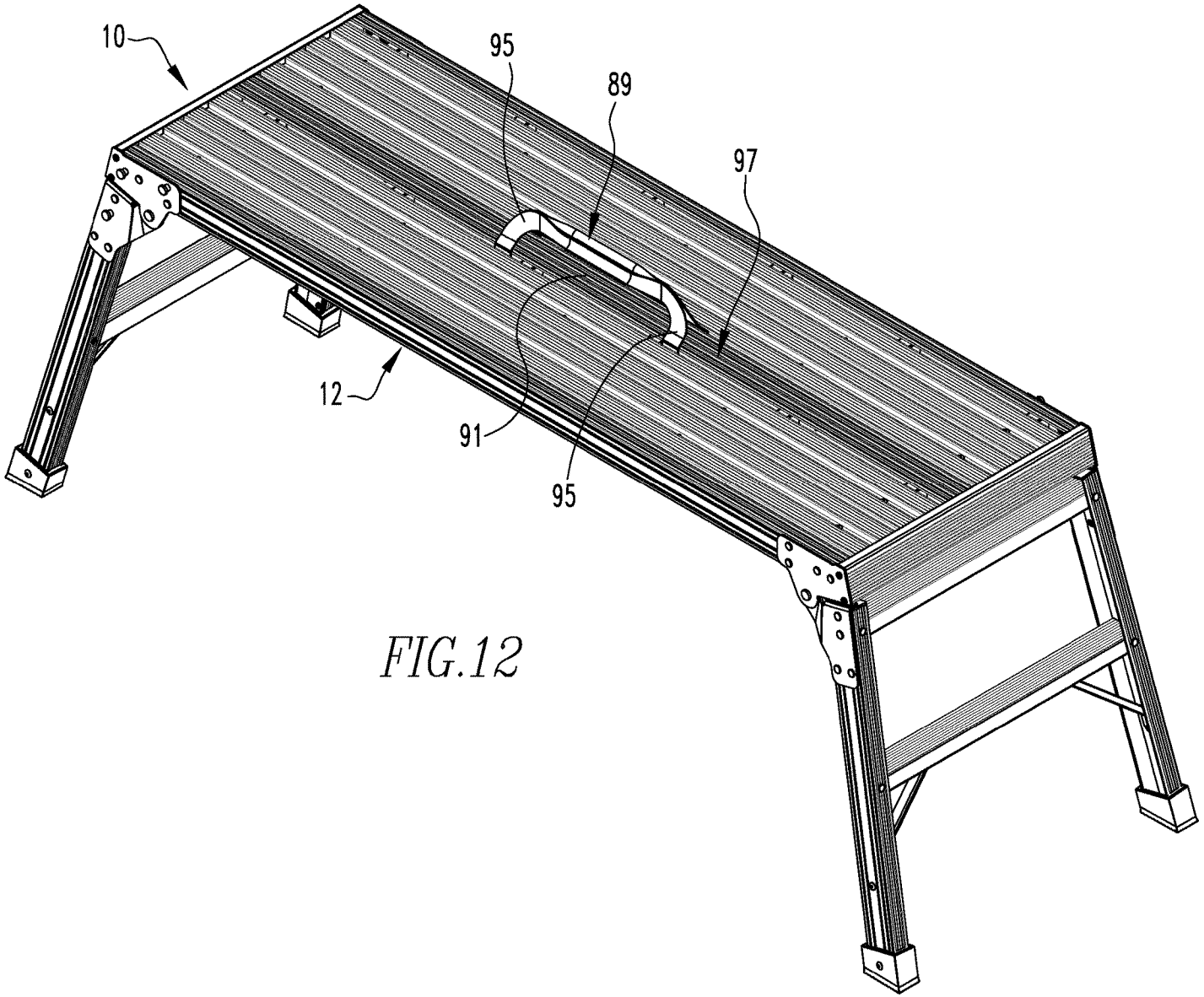
FIG. 12 is an overhead perspective view of the apparatus with a strap as they handle.
Figure 13:
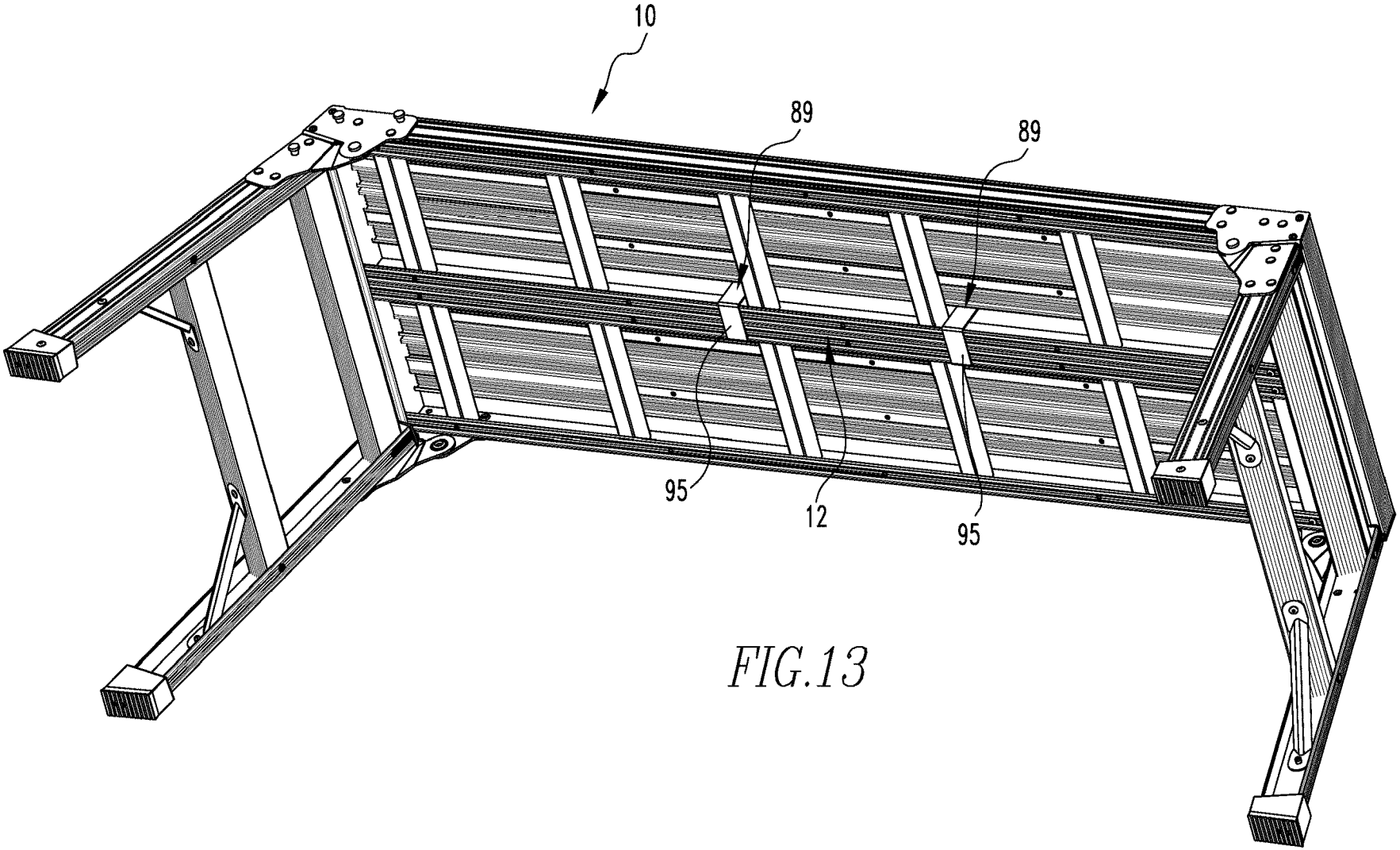
FIG. 13 is a perspective underside view of the apparatus with the strap.
Figure 14:
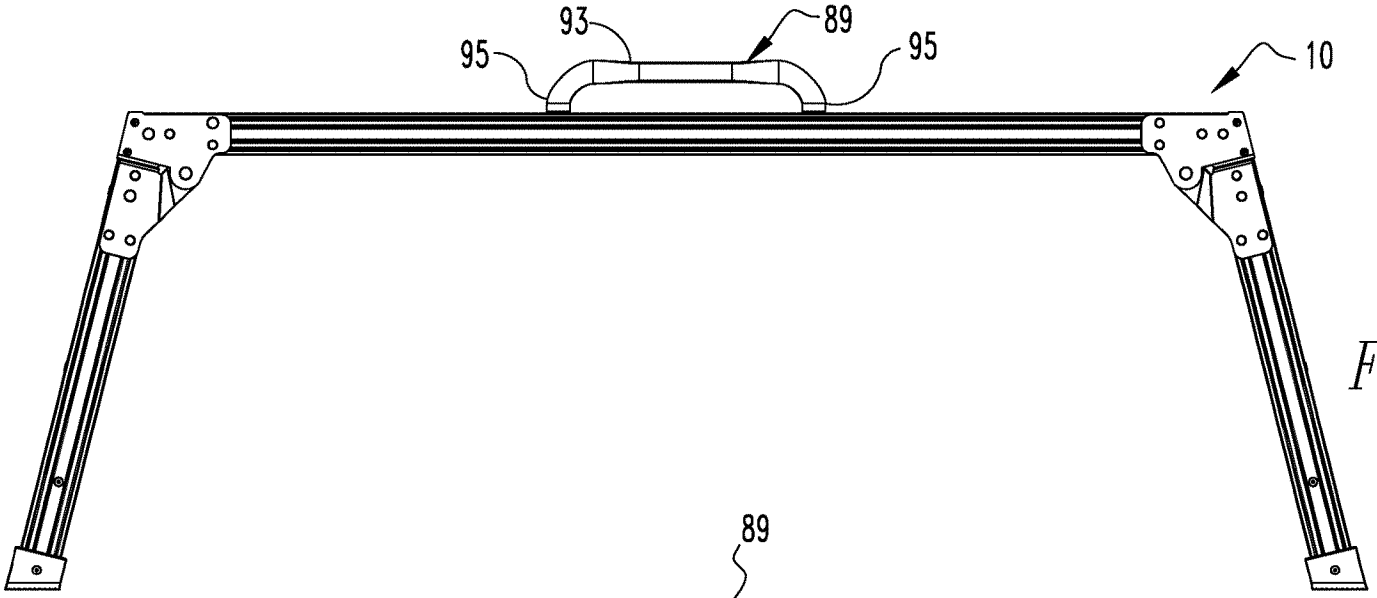
FIG. 14 is a side view of the apparatus with the strap.
Figure 15:
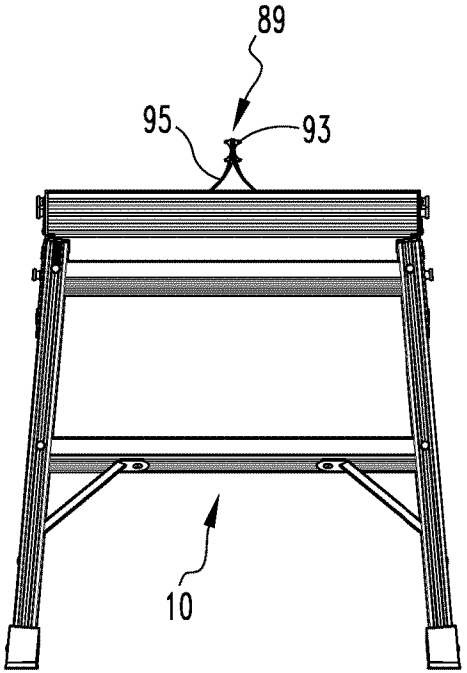
FIG. 15 is a front view of the apparatus with the strap.

FIGS. 9-11 are overhead, side and underneath views, respectively, of a handle insert with dimensions of a preferred embodiment. The dimensions of the insert may me changed depending on the loads and size of the apparatus 10.

For use, the apparatus 10 is carried by the user to a desired location, where the user unfolds each leg assembly until each leg assembly extends essentially perpendicularly from the platform 12, and is now in the use state. The operation of the hinges and the leg assemblies is well known with work platforms.

The user will then stand on the work platform 12 in conduct whatever actions are necessary. When the user desires to move the work platform 12 to another location, but does not want to have to fold the work platform 12 up to the folded state, and wants to have use of a hand to be free to hold an object while the user lifts and moves the work platform 12 in the use state, the user with one hand inserts a sum in the first slot 24 and the four fingers in the second slot 26 and grabs the portion of the platform 12 that is disposed between the first slot 24 and the second slot 26. This effectively acts as a handle 2 for the user to then lift the work platform 12 while it is in a use state, and move the work platform 12 to another location without the work platform 12 tipping. The work platform 12 would not tip since the handle 2 is in the center of the platform 12, and by lifting up the platform 12 basically straight up, with the weight of the platform 12 evenly distributed around the handle 2, there is no unbalanced side that would otherwise cause the platform 12 to tip as it is left and. This way, objects on the work platform 12, such as paint cans, or hands with putty or oils, can stay in place on the work platform 12 while it is being moved, without having to be removed from the platform 12 are closed up.

It can be seen that the disclosed handle 2 satisfies the need for a means by which a user can grasp, lift, and move a work platform 12 with one hand while maintaining the work platform 12 in an upright position.

The handle 2 described is only one of many possible ways to accomplish the goals of this invention. Various other possible means could include having straps or handles similar to those used on brief cases or suit cases which are attached to the deck of the work platform 12. These handles could be made to stow flush with the upper surface of the work platform 12 when not needed. The apparatus provides means for a user to pick up a work platform with one hand while allowing the work platform to remain in a generally level orientation.

The apparatus 10 may be a Werner AP-30 work platform, modified to include a handle 2, which has a duty rating or 1 and able to support at least 250 pounds of load. The apparatus 10 can support greater loads, such as at least 500 pounds if so desired, with the platform and leg assemblies made thicker in material to support the increased load.

In an alternative view, as shown in FIGS. 12-15, the handle 2 alternatively is a strap 89 that is attached to the platform 12 at its middle 28 in a longitudinal relationship with the centerline 33 and at the balance point 91 of the apparatus 10. The strap 89 has an elongate portion 93 in spaced relationship with the platform 12 which a user grabs to lift the apparatus 10, and opposing connection portions 95 which extend down from the elongate portion 93 of the strap 89 and wrap around the center decking 97 of the platform 12 to attach the strap 89 to the platform 12. The opposing connection portions 95 split and form a loop around the center decking 97 to attach the strap 89 to the platform 12. By being positioned at the bellows 91 along the centerline 33, when the apparatus 10 is lifted by the strap 89, the platform 12 should not tip, but remain level. The strap 89 is between 0.5 inches thick and 3 inches thick and can be made out of cloth, plastic or metal. The elongate portion 93 can have chamfered or rounded edges so it is comfortable for the user to grab and limits any rubbing, cutting or pressure points to the user's hand.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. An apparatus on which a user with hands stands comprising:

a platform having a first end and a second end and a handle, and a middle, the handle is disposed in the platform, the handle has a first slot and a second slot adjacent the first slot, the first and second slots disposed essentially in the platform's middle, the platform has a centerline and the apparatus has a center of gravity, the first slot is disposed on a first side of the centerline and above the apparatus' center of gravity and the second slot is disposed on a second side of the centerline and above the apparatus' center of gravity, a pair of handle inserts are located in respective ones of the first and second slots, the handle inserts insure that any potentially rough edges remaining after the first slot and the second slot are formed in the work platform decking are covered up, the inserts also provide a deeper gripping surface for comfort of the user, the inserts made of molded plastic, each insert has holes through which fasteners extend perpendicular to a longitudinal axis of the insert to hold the insert to a support bar;

a first leg assembly rotatably attached to the platform in proximity to the first end; and a second leg assembly rotatably attached to the platform in proximity to the second end, when the first and second leg assemblies are essentially in parallel with the platform, the apparatus is in a folded state, when the first and second leg assemblies are essentially perpendicular to the platform, the apparatus is in a use state, and the user is able to stand on the platform and be supported by the first and second leg assemblies, when the apparatus is in the use state, the user is able to pick up the apparatus by the handle with only one of the user's hands without tipping the apparatus, the apparatus able to support at least 250 lbs. of load.

2. The apparatus of claim 1 wherein each slot has a first elongate side and a second elongate side essentially in parallel in spaced relation with the first elongate side, with each elongate side essentially in parallel with the centerline.

3. The apparatus of claim 2 wherein each slot has an oval shape.

4. The apparatus of claim 3 wherein said handle inserts include a first insert and a second insert, and wherein the first insert fits in the first slot and conforms to the oval shape of the first slot and the second insert fits in the second slot and conforms to the oval shape of the second slot.

5. The apparatus of claim 4 wherein the first and second leg assembly each comprise a first leg and a second leg in spaced relation and in parallel with the first leg.

6. The apparatus of claim 5 wherein each leg assembly has a step attached between the first and second legs on which the user steps to reach and stand on the platform when the apparatus is in the use state.

7. An apparatus on which a user with hands stands comprising:

a platform having a first end and a second end, a bottom, a middle, a longitudinal centerline and a handle disposed in the platform, the handle has a first slot and a second slot adjacent the first slot, the first slot and second slot disposed essentially in the platform's middle and having an oval shape;

a support bar attached to the platform's bottom extending along the platform's centerline;

a first insert made of plastic disposed in the first slot and attached to the support bar with screws or rivets, the first insert having a first shape which conforms with a second shape of the first slot;

a second insert made of plastic disposed in the second slot and attached to the support bar with screws or rivets, the second insert having a third shape which conforms with a fourth shape of the second slot, the apparatus has a center of gravity, the first slot is disposed on a first side of the centerline and above the apparatus' center of gravity and the second slot is disposed on a second side of the centerline and above the platform's center of gravity, the first and second inserts insure that any potentially rough edges remaining after the first slot and the second slot are formed in the work platform decking are covered up, the inserts also provide a deeper gripping, surface for comfort of the user, each insert has holes through which fasteners extend perpendicular to a longitudinal axis of the insert to hold the insert to a support bar;

a first leg assembly, rotatably attached to the platform in proximity to the first end; and a second leg assembly rotatably attached to the platform in proximity to the second end, when the first and second leg assemblies are essentially in parallel with the platform, the apparatus is in a folded state, when the first and second leg assemblies are essentially perpendicular to the platform, the apparatus is in a use state and the user is able to stand on the platform and be supported by the first and second leg assemblies, when the apparatus is in the use state, the user is able to pick up the apparatus by the handle with only one of the user's hands without tipping the apparatus, the apparatus able to support at least 250 lbs. of load.

8. An apparatus on which a user with hands stands comprising:

platform having a first end and a second end and a handle and a middle, the handle is disposed in the platform, the handle has a first slot, the first slot disposed essentially in the platform's middle, the apparatus has a center of gravity, the first slot is disposed above the apparatus' center of gravity, a handle insert is located in the first slot, the handle insert insures that any potentially rough edges remaining after the first slot is formed in the work platform decking are covered up, the handle insert also provides a deeper gripping surface for comfort of the user, the insert made of molded plastic, the handle insert has holes through which fasteners extend perpendicular to a longitudinal axis of the insert to hold the insert to a support bar;

a first leg assembly rotatably attached to the platform in proximity to the first end; and a second leg assembly rotatably attached to the platform in proximity to the second end, when the first and second leg assemblies are essentially in parallel with the platform, the apparatus is in a folded state, when the first and on leg assemblies are essentially perpendicular to the platform, the apparatus is in a use state and the user is able to stand on the platform and be supported by the first and second leg assemblies, when the apparatus is in the use state, the user is able to pick up the apparatus by the handle with only one of the hands without tipping the apparatus, the apparatus able to support at least 250 lbs. of load.

* * * * *